US009073325B2

(12) United States Patent
Kameyama

(10) Patent No.: US 9,073,325 B2
(45) Date of Patent: Jul. 7, 2015

(54) INK JET PRINTING APPARATUS HAVING LOW-NOISE COMPACT PUMP TUBE CAPABLE OF RAISING SUCTION PRESSURE

(71) Applicant: CANON KABUSHIKI KAISHA, Tokyo (JP)

(72) Inventor: Fumie Kameyama, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/451,134

(22) Filed: Aug. 4, 2014

(65) Prior Publication Data

US 2015/0042718 A1 Feb. 12, 2015

(30) Foreign Application Priority Data

Aug. 8, 2013 (JP) ..... 2013-165122

(51) Int. Cl.
*B41J 2/165* (2006.01)

(52) U.S. Cl.
CPC .... *B41J 2/16505* (2013.01); *B41J 2002/16594* (2013.01)

(58) Field of Classification Search
USPC ..... 347/30, 29, 22
See application file for complete search history.

(56) References Cited

U.S. PATENT DOCUMENTS 7,654,803 B2 * 2/2010 Harada et al. ..... 417/477.11

FOREIGN PATENT DOCUMENTS

JP 2008-049565 A 3/2008

* cited by examiner

*Primary Examiner* — Henok Legesse
(74) *Attorney, Agent, or Firm* — Canon U.S.A., Inc. IP Division

(57) ABSTRACT

An ink jet printing apparatus includes a first fixing member including a first coupling portion coupled to a cap-side end of a first pump tube and a second coupling portion coupled to a waste ink storage portion-side end of a second pump tube. The distance from a reference surface of a pump base to the first coupling portion is different from the distance from the reference surface of the pump base to the second coupling portion.

8 Claims, 10 Drawing Sheets

--Prior Art--

INK JET PRINTING APPARATUS HAVING LOW-NOISE COMPACT PUMP TUBE CAPABLE OF RAISING SUCTION PRESSURE

BACKGROUND OF THE INVENTION

1. Field of the Invention

The present invention relates an ink jet printing apparatus. Specifically, the present invention relates to a tube pump used in ejection recovery operations for maintaining and recovering an ejection performance of a print head for ejecting ink.

2. Description of the Related Art

FIG. 10 is a plan view of a tube pump in related art described in Japanese Patent Laid-Open No. 2008-49565. In FIG. 10, a first pump tube 325 is coupled to a first cap, and a second pump tube 326 is coupled to a second cap. The first pump tube 325 and the second pump tube 326 are arranged along arc-shaped guide portions 327*a* and 327*b* disposed on a pump base 327, respectively. Rollers 331, 332, and 333 press the first pump tube 325 and the second pump tube 326. The rollers 331, 332, and 333 include shaft portions 331*a*, 332*a*, and 333*a*, respectively, and are fit in grooves in a roller holder 330.

When the roller holder 330 is rotated in the direction of the arrow A in FIG. 10, the shaft portions 331*a*, 332*a*, and 333*a* of the rollers move while rotating in the grooves of the roller holder 330. With this, the rollers 331, 332, and 333 move to positions where they press the first pump tube 325 and the second pump tube 326. When the roller holder 330 is rotated continuously in the direction of the arrow A in the state where the first pump tube 325 and the second pump tube 326 are pressed, the inside of each of the first pump tube 325 and the second pump tube 326 can be brought into a negative pressure state. Accordingly, ink can be sucked from a print head using the first cap and the second cap.

When the roller holder 330 is rotated in the direction of the arrow B in FIG. 10, the shaft portions 331*a*, 332*a*, and 333*a* of the rollers move in the direction opposite to the above-described direction while rotating in the grooves in the roller holder 330. With this, the rollers 331, 332, and 333 move to positions where they do not press the first pump tube 325 or the second pump tube 326.

The first pump tube 325 and the second pump tube 326 are near each other in introduction portions from the outside of the pump base 327 to the pump base 327. Thus the rollers 331, 332, and 333 are in contact with both the first pump tube 325 and the second pump tube 326 when passing through the introduction portions.

To increase the print speed, the print head has nozzles more than those of a traditional print head. To perform a suction recovery operation for the print head having many nozzles, it is necessary to raise the suction pressure and increase the amount of ink sucked.

The suction pressure can be raised by an increase in the rotational speed of the roller holder. In that case, however, there is a problem that noise of the driving source for the roller holder is increased.

An increase in the inner diameter of each of the pump tubes can increase the amount of reduction in the inner volume of the pump tube when it is pressed by the roller and thus can raise the suction pressure. However, the increased inner diameter of the pump tube leads to increased rigidity of the pump tube, and this makes it difficult to arrange the two pump tubes in positions near each other in the introducing portions to the pump base.

There is a configuration in which a roller holder of a tube pump is rotated by driving of a conveyance motor for driving a conveyance roller for conveying a printing medium. This configuration aims to avoid increase in cost of the apparatus caused by the addition of another driving source for rotating the roller holder. The roller holder rotates in the direction of the arrow B in FIG. 10 in conveyance of the printing medium. The configuration in which the first and second pump tubes are not near each other in the introducing portions has a trouble described below occurring when the rollers pass through the introducing portions together with rotation of the roller holder.

That is, each of the rollers is repelled in the direction of rotation of the roller holder by a reaction force of a first pump tube in contact with the roller before the roller passes through the introducing portion. Because a second pump tube is remote from the first pump tube, the roller repelled by the reaction force of the first pump tube cannot come into contact with the second pump tube. Thus there are technical problems in that the roller may collide with the pump base, the shaft portion of the roller may collide with the groove in the roller holder, and thus noise may occur.

SUMMARY OF THE INVENTION

The present invention provides an ink jet printing apparatus including a low-noise compact pump tube capable of raising a suction pressure.

An ink jet printing apparatus according to an aspect of the present invention includes a cap for capping an ejection port surface of a print head for ejecting ink, first and second pump tubes communicating with the cap, a guide member including a guide surface for guiding the first and second pump tubes and a reference surface intersecting with the guide surface, a pump roller for pressing the first and second pump tubes, a waste ink storage portion configured to store waste ink ejected from the first and second pump tubes, and a first fixing member including a first coupling portion coupled to a cap-side end of the first pump tube and a second coupling portion coupled to a waste ink storage portion-side end of the second pump tube. A distance from the reference surface to the first coupling portion and a distance from the reference surface to the second coupling portion are different.

Further features of the present invention will become apparent from the following description of exemplary embodiments with reference to the attached drawings.

DESCRIPTION OF THE EMBODIMENTS

First Embodiment

Embodiments of the present invention are described below with reference to the drawings.

Figure 1:
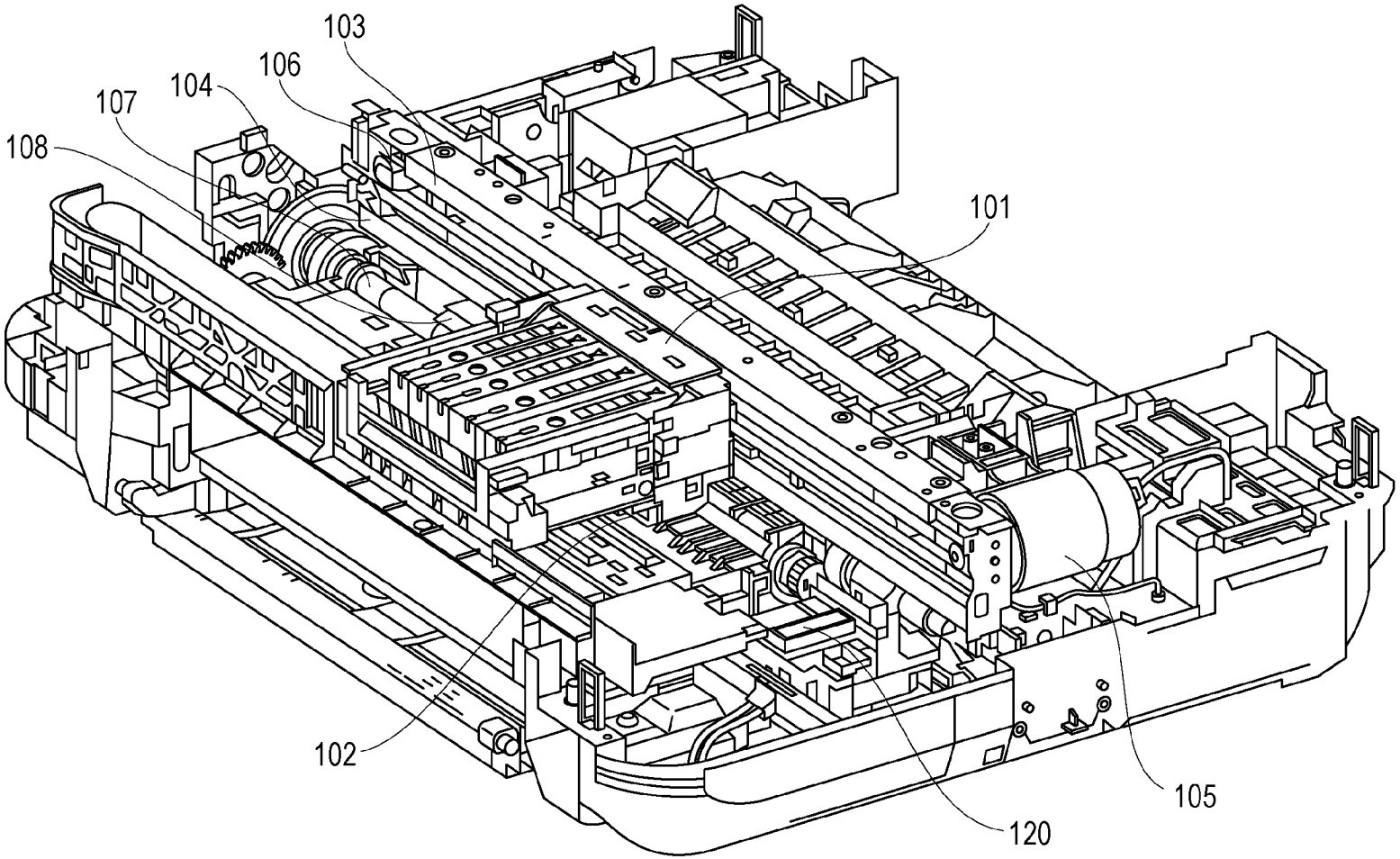
FIG. 1 is a schematic perspective view of an ink jet printing apparatus according to a first embodiment of the present invention.

FIG. 1 is a schematic perspective view of an ink jet printing apparatus according to a first embodiment of the present invention. In FIG. 1, a print head 102 for ejecting ink and printing data on a printing medium is mounted on a carriage 101. The print head 102 is configured to eject ink using thermal energy and includes an electro-thermal transducer for generating the thermal energy. Specifically, the print head 102 ejects ink through ejection ports utilizing a change in pressure (change of state) resulting from growth or shrinkage of bubbles caused by film boiling generated by thermal energy applied by the electro-thermal transducer.

The carriage 101 is movably guided and supported by a first rail 103 and a second rail 104. The carriage 101 can be reciprocated by a driving force transmitted from a carriage motor 105 through a belt 106.

One example of a printing medium can be a printing sheet. The printing sheet is conveyed by a pair of conveyance rollers consisting of a conveying roller 107 and a pinching roller 108 and a pair of a discharge rollers consisting of a discharging roller and an auxiliary discharging roller.

The carriage 101 moves at a constant speed after accelerating from a stopped state. While the carriage 101 moves at the constant speed, a printing operation is performed by ejecting ink onto the printing medium from the print head 102 driven based on print data. When the printing operation for one line is completed, the carriage 101 decelerates and stops. Then the carriage 101 is reversed, and the printing operation for the next line is performed. The printing sheet is conveyed by a predetermined amount by rotation of the conveying roller 107 between the printing operation for the previous line and that for the next line. The printing operation for the entire printing sheet is performed by repetition of the printing operation by the print head 102 with movement of the carriage 101 and the conveying operation for the printing sheet by the conveying roller 107. When the printing operation for the printing sheet is completed, the printing sheet is discharged from the printing apparatus by the pair of conveyance rollers.

In FIG. 1, a recovery unit for maintaining and recovering the ink ejection performance of the print head 102 is arranged in a position deviating from a printing area where the printing operation is performed on the printing sheet by the print head 102. The recovery unit is provided with a cap 120 for capping the ejection port surface of the print head 102. The cap 120 caps the ejection port surface of the print head 102 when no printing operation is performed. Thickening ink or bubbles in ink can be removed through the print head by driving a tube pump described below in the state where the ejection port surface is capped by the cap 120.

Figure 2:
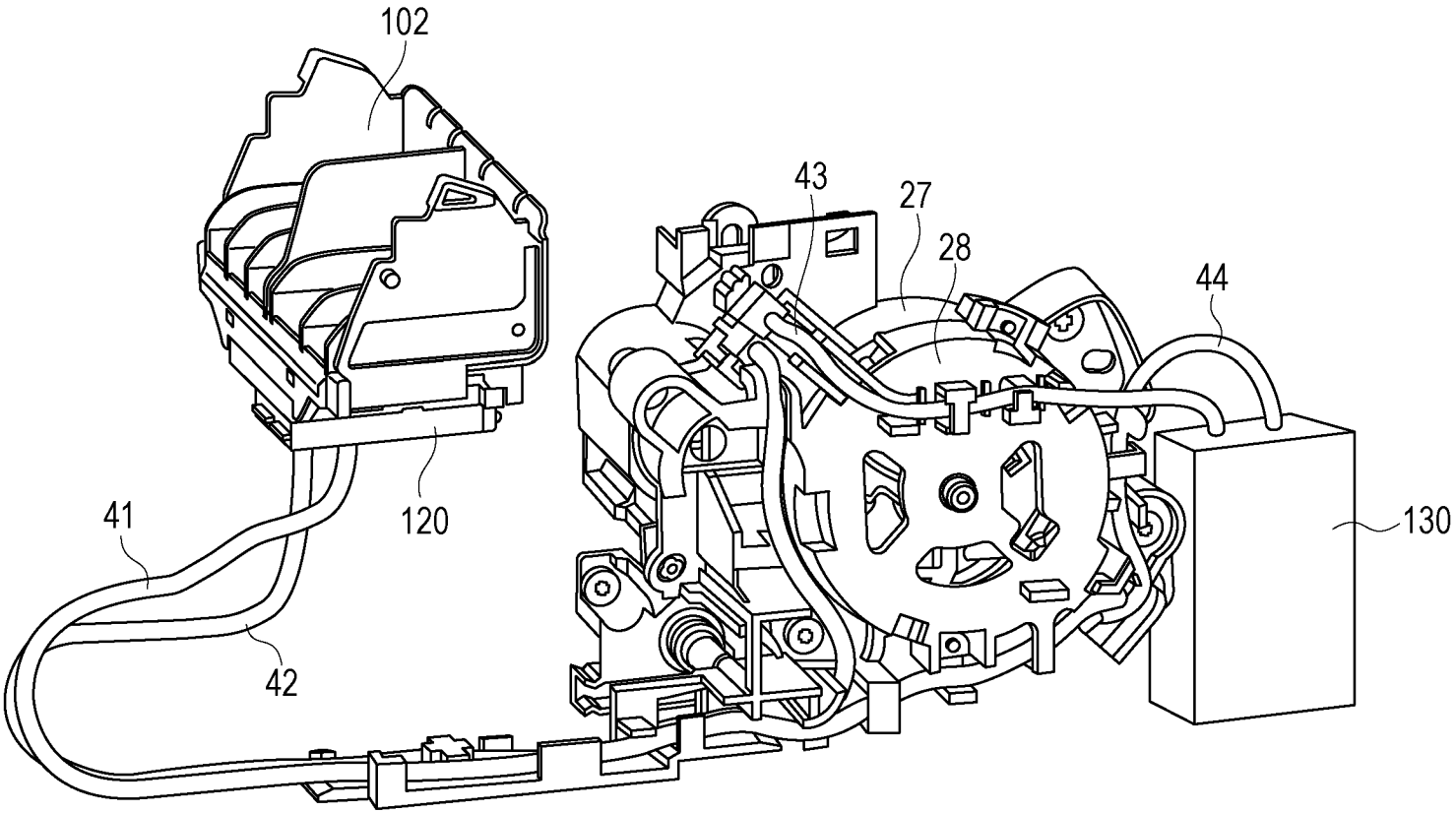
FIG. 2 is an illustration for describing a configuration of a suction recovery unit.

FIG. 2 is an illustration for describing a configuration of the suction recovery unit. In FIG. 2, in a suction recovery process, the cap 120 is in close contact with the ejection port surface of the print head 102. The print head 102 includes an array of ejection ports allowing pigment ink to be ejected therethrough and an array of ejection ports allowing dye ink to be ejected therethrough. The cap 120 is the one in which a first cap for capping the array of ejection ports for the pigment ink and a second cap for the dye ink are integrated.

A first cap tube 41 has a first end communicating with the first cap. A second cap tube 42 has a first end communicating with the second cap. Each of the first cap tube 41 and the second cap tube 42 has a second end communicating with a tube pump described below.

A waste ink storage portion 130 is configured to store waste ink ejected by the tube pump. A first waste ink tube 43 is used to eject pigment ink ejected by the tube pump to the waste ink storage portion 130. A second waste ink tube 44 is used to eject dye ink ejected by the tube pump to the waste ink storage portion 130.

The first cap tube 41 and the first waste ink tube 43 communicate with each other through a first pump tube 25 described below. The second cap tube 42 and the second waste ink tube 44 communicate with each other through a second pump tube 26 described below. The first cap tube 41, the first pump tube 25, and the first waste ink tube 43 may be configured as a single tube. The second cap tube 42, the second pump tube 26, and the second waste ink tube 44 may also be configured as a single tube. In the present embodiment, the configuration in which three tubes are coupled together for each line is used to enhance the ease of assembly.

The tube pump further includes a pump base 27 and a pump cover 28 described below.

Figure 3:
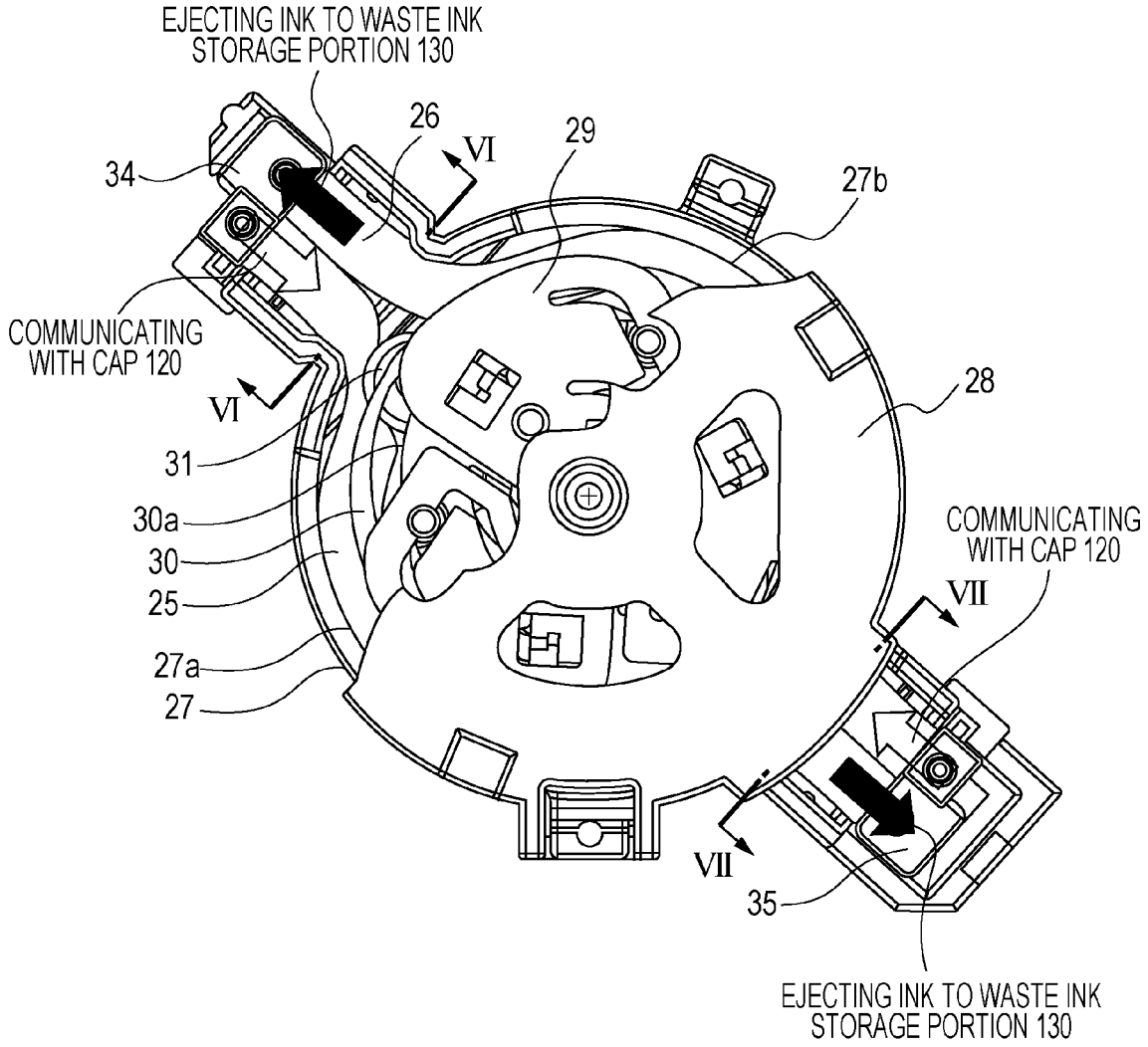
FIG. 3 is an illustration for describing a configuration of a tube pump.

FIG. 3 is an illustration for describing a configuration of the tube pump. In FIG. 3, the first pump tube 25 has a first end communicating with the first cap tube 41 at a first tube joint 34, which is a first fixing member. That is, the first end of the first pump tube 25 communicates with the first cap through the first cap tube 41. The first pump tube 25 has a second end communicating with the first waste ink tube 43 at a second tube joint 35, which is a second fixing member. That is, the second end of the first pump tube 25 communicates with the waste ink storage portion 130 through the first waste ink tube 43.

The second pump tube 26 has a first end communicating with the second cap tube 42 at the second tube joint 35. That is, the first end of the second pump tube 26 communicates with the second cap through the second cap tube 42. The second pump tube 26 has a second end communicating with the second waste ink tube 44 at the first tube joint 34. That is, the second end of the second pump tube 26 communicates with the waste ink storage portion 130 through the second waste ink tube 44.

The first end (cap-side end) of the first pump tube 25 and the second end (waste ink storage portion-side end) of the second pump tube 26 are fixed on the first tube joint 34, which is the first fixing member. The second end (waste ink storage portion-side end) of the first pump tube 25 and the first end (cap-side end) of the second pump tube 26 are fixed on the second tube joint 35, which is the second fixing member. The first tube joint 34 and the second tube joint 35 are fixed on the pump base 27.

The pump base 27 constitutes a guide member including a first guide surface 27*a* for guiding the first pump tube 25 and a second guide surface 27*b* for guiding the second pump tube 26. The first guide surface 27*a* and the second guide surface 27*b* have arc shapes having a common center. The pump base 27 also includes a reference surface intersecting with the first guide surface 27*a* and the second guide surface 27*b*.

A pump roller wheel (rotating member) 29 is disposed on the pump base 27 such that it is rotatable by its shaft core coaxial with the center of the first guide surface 27*a* and the second guide surface 27*b*. The pump roller wheel 29 engages with three pump roller holders 30 through an urging member. The pump roller holders 30 are urged outward by the urging member. Each of the pump roller holders 30 has a groove 30*a*.

Pump rollers 31, 32, and 33 capable of pressing the first pump tube 25 and the second pump tube 26 engage with the respective grooves 30*a* in the pump roller holders 30. The pump rollers 31, 32, and 33 can revolve around the center of the pump base 27 together with rotation of the pump roller wheel 29. The pump rollers 31, 32, and 33 can relatively move with respect to the pump roller holders 30 while rotating on their respective axes in the grooves 30*a* in the pump roller holders 30. The reference surface is included in a surface that intersects with the rotation axis of the pump roller wheel 29 (rotating member). One example of the reference surface may be a bottom surface 27*c* of the pump base 27. The bottom surface 27*c* is perpendicular to the first guide surface 27*a* and the second guide surface 27*b*.

The pump cover 28 engages with the pump base 27. In FIG. 3, a part of the pump cover 28 is omitted to make the inside of the tube pump visible. The pump cover 28 includes a bearing portion for the pump roller wheel 29. That is, the pump roller wheel 29 is rotatably supported by the pump base 27 and the pump cover 28.

Figure 4:
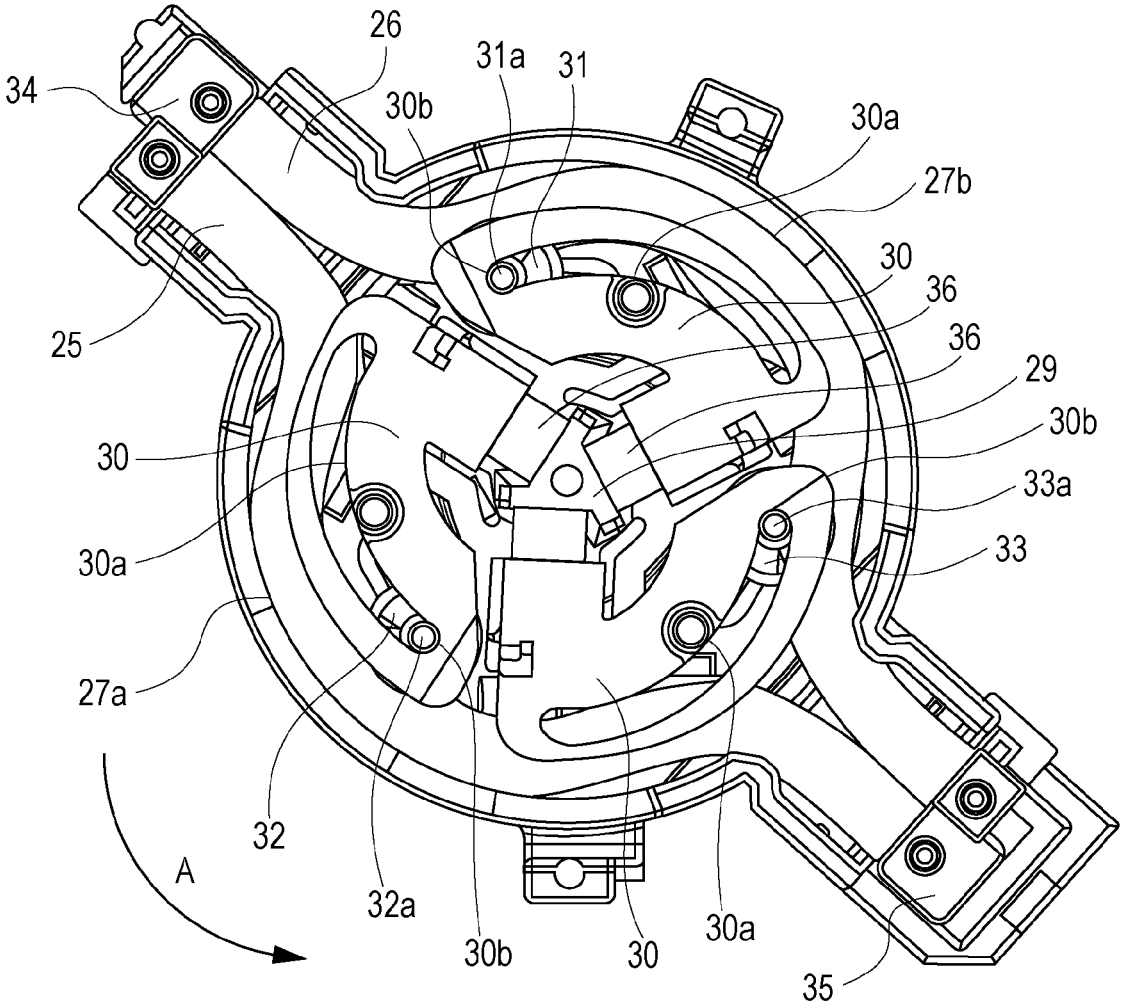
FIG. 4 is an illustration for describing the configuration of the tube pump without a pump cover.
Figure 5:
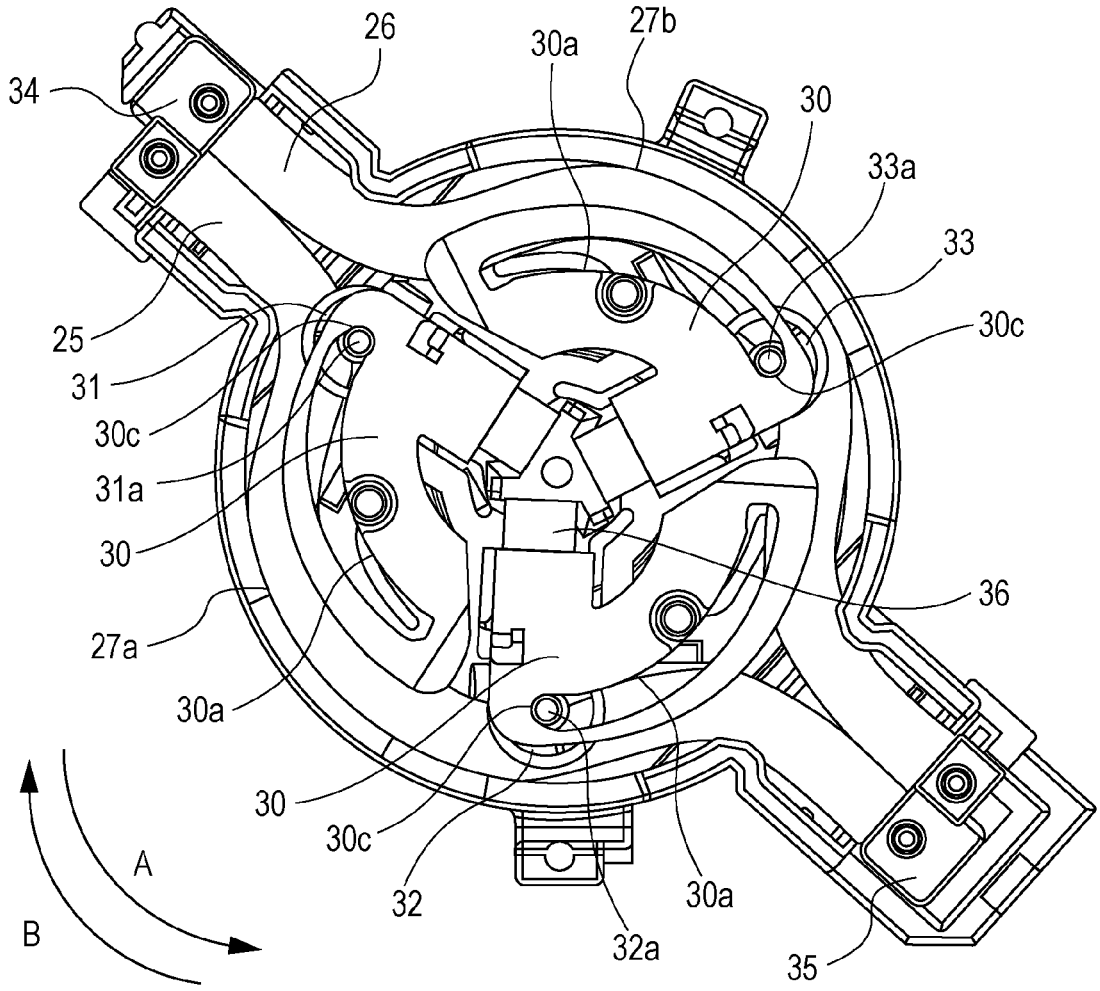
FIG. 5 is an illustration for describing the configuration of the tube pump without the pump cover.

FIGS. 4 and 5 are illustrations for describing the configuration of the tube pump without the pump cover.

In FIG. 4, as previously described, the pump roller wheel 29 engages with the three pump roller holders 30. A pump roller spring 36 is disposed between the pump roller wheel 29 and each of the pump roller holders 30. The urging force of the pump roller spring 36 enables the pump rollers 31, 32, and 33 held by the pump roller holders 30 to press the first pump tube 25 and the second pump tube 26. The pump roller holders 30 engages with the pump roller wheel 29 so as to be movable in a direction approaching the shaft core of the pump roller wheel 29 against the urging force of the pump roller spring 36.

The pump rollers 31, 32, and 33 include shaft portions 31*a*, 32*a*, and 33*a*, respectively. Engagement of the shaft portions 31*a*, 32*a*, and 33*a* with the grooves 30*a* in the pump roller holders 30 enables the pump rollers 31, 32, and 33 to relatively move with respect to the pump roller holders 30.

In FIG. 4, each of the shaft portions 31*a*, 32*a*, and 33*a* is in a release position 30*b*at one end of the groove 30*a* in the pump roller holder 30. When the shaft portions 31*a*, 32*a*, and 33*a* are in the release positions 30*b*, the distance from each of the pump rollers 31, 32, and 33 to the location of the center of the pump base 27 is relatively short. At this time, each of the pump rollers 31, 32, and 33 is in a release state where it does not press the first pump tube 25 or the second pump tube 26.

Rotation of the pump roller wheel 29 in the direction of the arrow A illustrated in FIG. 4 brings the inside of each of the first pump tube 25 and the second pump tube 26 into a negative pressure state, thus causing ink to be sucked from the print head 102.

When the pump roller wheel 29 is rotated in the direction of the arrow A from the state illustrated in FIG. 4, the state moves to that illustrated in FIG. 5. In FIG. 5, each of the shaft portions 31*a*, 32*a*, and 33*a* has moved to a pressing position 30*c* at another end of the groove 30*a* in the pump roller holder 30. When the shaft centers 31*a*, 32*a*, and 33*a* are in the pressing positions 30*c*, the distance from each of the pump rollers 31, 32, and 33 to the location of the center of the pump base 27 is relatively long. At this time, each of the pump rollers 31, 32, and 33 is in a pressing state where it presses the first pump tube 25 and the second pump tube 26.

When the pump roller wheel 29 in the state illustrated in FIG. 4 is rotated in the direction of the arrow A in the drawing, the pump rollers 31, 32, and 33 move together with the pump roller wheel 29 and the pump roller holders 30 while maintaining an open state where they do not press the first pump tube 25 or the second pump tube 26. That is, the relative positions of the pump rollers 31, 32, and 33 with respect to the pump roller holders 30 remain unchanged. When each of the pump rollers moves to the introducing portion in the vicinity of the first tube joint 34 or that in the vicinity of the second tube joint 35, the pump roller is in the state where it is in contact with both the first pump tube 25 and the second pump tube 26.

When the pump roller wheel 29 is further rotated in the direction of the arrow A, the pump roller in contact with the two pump tubes in the introducing portion is unable to move together with the pump roller holder 30. This is because the movement of the pump roller is disabled by being in contact with the two pump tubes. With the rotation of the pump roller wheel 29 in the direction of the arrow A, the pump roller in the introducing portion is guided by the groove 30*a* in the pump roller holder 30 and relatively moves with respect to the pump roller holder 30. When the shaft portion of the pump roller moves to the pressing position 30*c*, which is at another end of the groove 30*a* in the pump roller holder 30, the pump roller starts moving together with the pump roller holder 30. The three pump rollers sequentially move to the pressing positions 30*c* by the positional relationships with the introducing portions.

Movement of the pump rollers together with the pump roller wheel 29 in the state where the shaft portions of the pump rollers are in the pressing positions enables the first pump tube 25 and the second pump tube 26 to be squeezed. In the present embodiment, the three pump rollers 31, 32, and 33 are provided for the two pump tubes 25 and 26. Thus one pump tube is pressed by one or two pump rollers on all occasion. Accordingly, rotation of the pump roller wheel 29 in the direction of the arrow A enables a negative pressure to be continuously generated in the first pump tube 25 and the second pump tube 26. The negative pressure state of the first pump tube 25 brings the first cap tube 41 and the first cap into the negative pressure state, thus enabling ink to be ejected through the array of ejection ports for use in ejecting the pigment ink. The negative pressure state of the second pump tube 26 brings the second cap tube 42 and the second cap into the negative pressure state, thus enabling ink to be ejected through the array of ejection ports for use in ejecting the dye ink.

Figure 6:
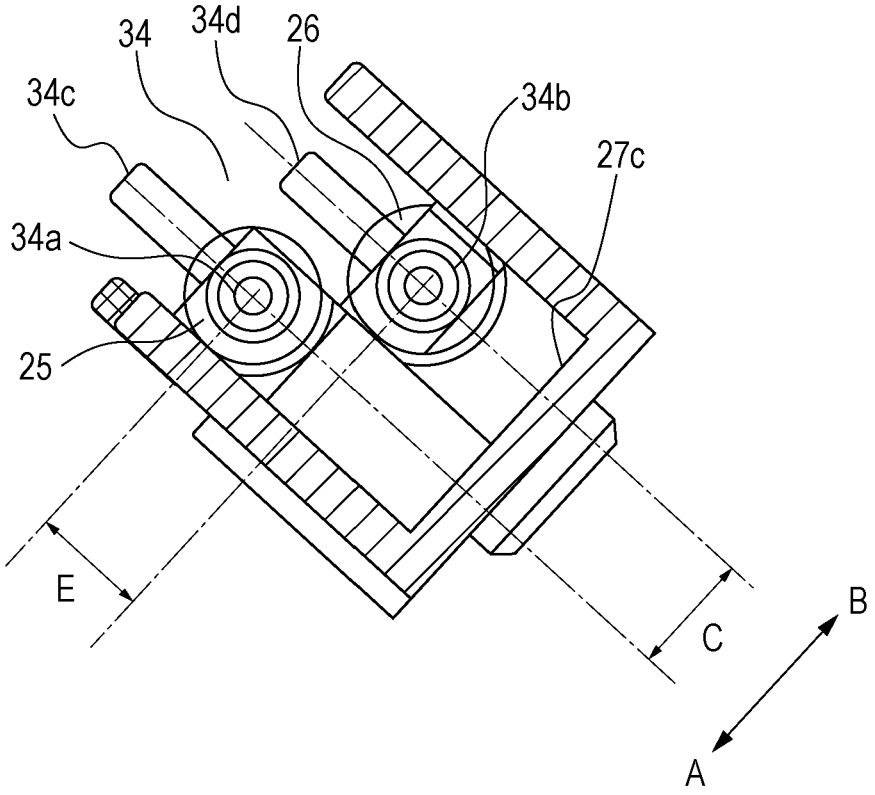
FIG. 6 illustrates arrangement of pump tubes at a first tube joint.

FIG. 6 is a cross-sectional view taken along the line VI-VI in FIG. 3. That is, FIG. 6 illustrates arrangement of the pump tubes at the first tube joint 34, which is the first fixing member. In FIG. 6, the first tube joint 34 includes a first coupling portion 34*a* coupled to the first end (cap-side end) of the first pump tube 25 and a second coupling portion 34*b* coupled to the second end (waste ink storage portion-side end) of the second pump tube 26. That is, the first coupling portion 34*a* is coupled to the cap-side end of the first pump tube 25, and the second coupling portion 34*b* is coupled to the waste ink storage portion-side end of the second pump tube 26. The first tube joint 34 further includes a third coupling portion 34*c* coupled to the first cap tube 41 and a fourth coupling portion 34*d* coupled to the second waste ink tube 44.

In FIG. 6, the first pump tube 25 and the second pump tube 26 are displaced from each other by only E in the axial direction of the pump roller wheel 29. In other words, the first pump tube 25 and the second pump tube 26 are displaced from each other by only E in the thickness direction of the tube pump. With this configuration, the first pump tube 25 and the second pump tube 26 can be arranged near each other with respect to a direction intersecting with the axial direction of the pump roller wheel 29, that is, with respect to the direction of the reference surface of the pump base 27. That is, the first pump tube 25 and the second pump tube 26 can be arranged in positions displaced by only C, which is smaller than the sum of the radius of the first pump tube 25 and the radius of the second pump tube 26, with respect to the rotational direction A-B of the pump roller wheel 29.

Figure 7:
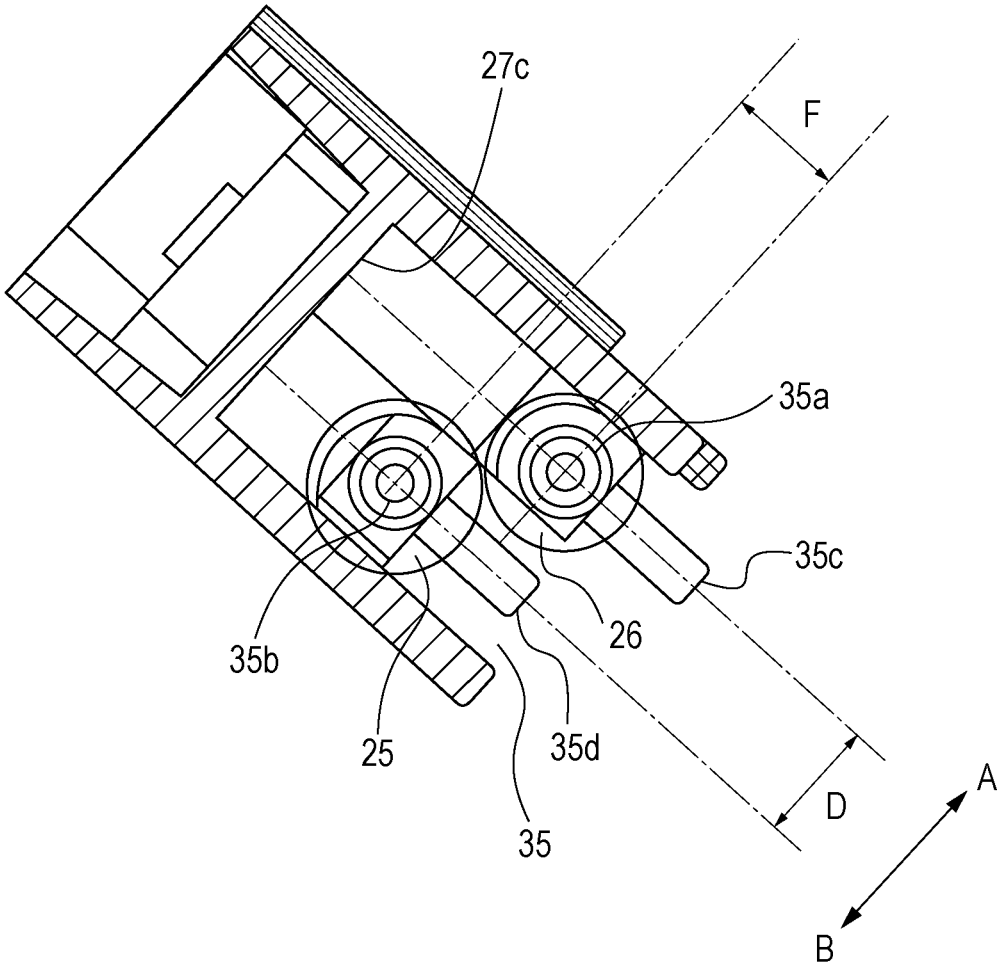
FIG. 7 illustrates arrangement of the pump tubes at a second tube joint.

FIG. 7 is a cross-sectional view taken along the line VII-VII in FIG. 3. That is, FIG. 7 illustrates arrangement of the pump tubes at the second tube joint 35, which is the second fixing member. In FIG. 7, the second tube joint 35 includes a first coupling portion 35*a* coupled to the first end (cap-side end) of the second pump tube 26 and a second coupling portion 35*b* coupled to the second end (waste ink storage portion-side end) of the first pump tube 25. That is, the first coupling portion 35*a* is coupled to the cap-side end of the second pump tube 26, and the second coupling portion 35*b* is coupled to the waste ink storage portion-side end of the first pump tube 25. The second tube joint 35 further includes a third coupling portion 35*c* coupled to the second cap tube 42 and a fourth coupling portion 35*d* coupled to the first waste ink tube 43.

In FIG. 7, the first pump tube 25 and the second pump tube 26 are displaced from each other by only F in the axial direction of the pump roller wheel 29. In other words, the first pump tube 25 and the second pump tube 26 are displaced from each other by only F in the thickness direction of the tube pump. The value of F may be the same as or different from the value of E described with reference to FIG. 6. With this configuration, the first pump tube 25 and the second pump tube 26 can be arranged near each other with respect to a direction intersecting with the axial direction of the pump roller wheel 29, that is, with respect to the direction of the reference surface of the pump base 27. That is, the first pump tube 25 and the second pump tube 26 can be arranged in positions displaced by only D, which is smaller than the sum of the radius of the first pump tube 25 and the radius of the second pump tube 26, with respect to the rotational direction B-A of the pump roller wheel 29. The value of D may be the same as or different from the value of C described with reference to FIG. 6.

Figure 8:
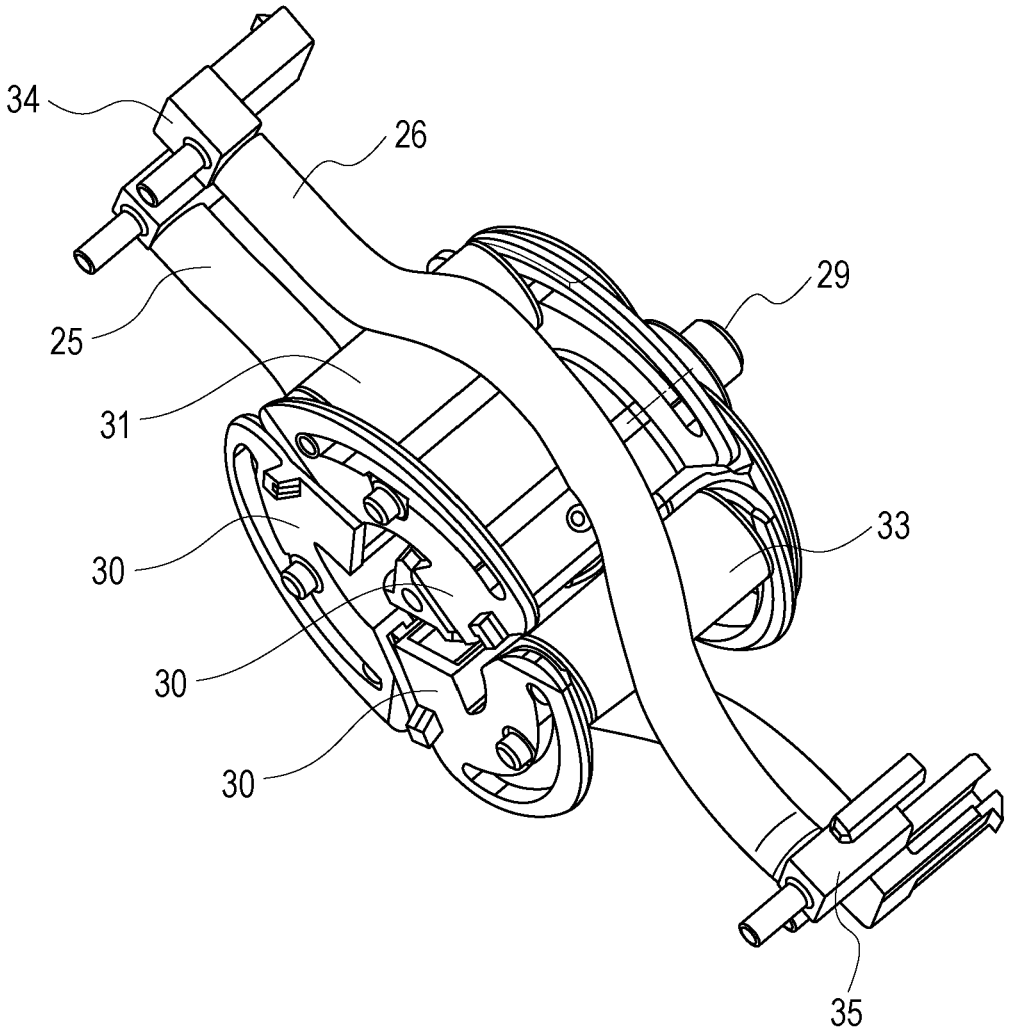
FIG. 8 is a perspective view of the tube pump without a pump base and the pump cover.

FIG. 8 is a perspective view of the tube pump without the pump base and the pump cover. As described with reference to FIGS. 6 and 7, the first pump tube 25 and the second pump tube 26 are displaced from each other in the axial direction of the pump roller wheel 29 in the vicinity of the first tube joint 34. The first pump tube 25 and the second pump tube 26 are displaced from each other in the axial direction of the pump roller wheel 29 in the vicinity of the second tube joint 35. In the present embodiment, the positional relationship between the first pump tube 25 and the second pump tube 26 at the first tube joint 34 is opposite to that at the second tube joint 35 with respect to the reference surface of the pump base. However, the positional relationship between the two pump tubes at the first tube joint 34 may be the same as that at the second tube joint 35.

An operation of shifting the pressing state in which the pump rollers press the pump tubes to the release state in which the pressing by the pump rollers is released is described with reference to FIG. 5. The pump roller wheel 29 is rotated in the direction of the arrow B in FIG. 5 from the pressing state illustrated in the drawing by a pump gear (not illustrated). The pump rollers 31, 32, and 33 move together with the pump roller wheel 29 and the pump roller holders 30 while maintaining the pressing state of pressing the first pump tube 25 and the second pump tube 26. That is, the relative positions of the pump rollers 31, 32, and 33 with respect to the pump roller holder 30 remain unchanged. When each of the pump rollers moves to the introducing portion in the vicinity of the first tube joint 34 or that in the vicinity of the second tube joint 35, the pump roller is detached from the pump tube pressed by that pump roller. Here, as described above, the first pump tube 25 and the second pump tube 26 are near each other. If the pump roller is repelled by the elastic force of the pump tube pressed by that pump roller when it is detached from that pump tube, the pump roller immediately comes into contact with another pump tube in the introducing portion, and thus no noise occurs. The pump roller having moved to the introducing portion is in in the state where it is in contact with both of the two pump tubes or where its range of movement is regulated by the two pump tubes.

When the pump roller wheel 29 is further rotated in the direction of the arrow B, the pump roller in the introducing portion is unable to move together with the pump roller holder 30. This is because the movement of the pump roller is disabled by the pump tubes. With the rotation of the pump roller wheel 29 in the direction of the arrow B, the pump roller in the introducing portion is guided by the groove 30*a* in the pump roller holder 30 and relatively moves with respect to the pump roller holder 30. When the shaft portion of the pump roller moves to the release position 30*b*, which is at one end of the groove 30*a* in the pump roller holder 30, the pump roller starts moving together with the pump roller holder 30. The three pump rollers sequentially move to the release positions 30*b* by positional relationships with the introducing portions.

With the above-described configuration, the two pump tubes can be near each other in the introducing portion. Thus if the pump roller is repelled when it is detached from one pump tube, the pump roller can immediately come into contact with another pump tube. Accordingly, collision of the pump roller can be absorbed by the elasticity of another pump tube.

There may be a case where a configuration is used in which the tube pump is driven by the conveyance motor for driving the conveyance roller for conveying the printing medium. In that case, when the conveyance roller is driven to rotate the conveyance roller, the tube pump is also driven. In that case, the pump rollers also move together with rotation of the pump roller wheel. Even with such a configuration, the occurrence of noise resulting from detachment of each of the pump rollers from the pump tube can be suppressed by the use of the configuration according to the present invention.

In FIGS. 6 and 7, the two pump tubes are arranged in positions displaced from each other by C and D with respect to the direction of the reference surface of the pump base 27. The amount of overlaps between the pump tubes may be increased. A positional relationship in which the two pump tubes fully overlap each other with respect to the direction of the reference surface of the pump base 27 may also be used. With that configuration, the occurrence of noise can be more reliably suppressed.

In the present embodiment, the configuration in which the three pump roller holders 30 engage with the pump roller wheel 29 through the urging member is used. Another configuration in which the pump roller wheel 29 and the three pump roller holders 30 are integrated may also be used.

As described above, according to the present embodiment, an ink jet printing apparatus including a low-noise compact pump tube capable of raising a suction pressure can be provided.

Second Embodiment

Figure 9:
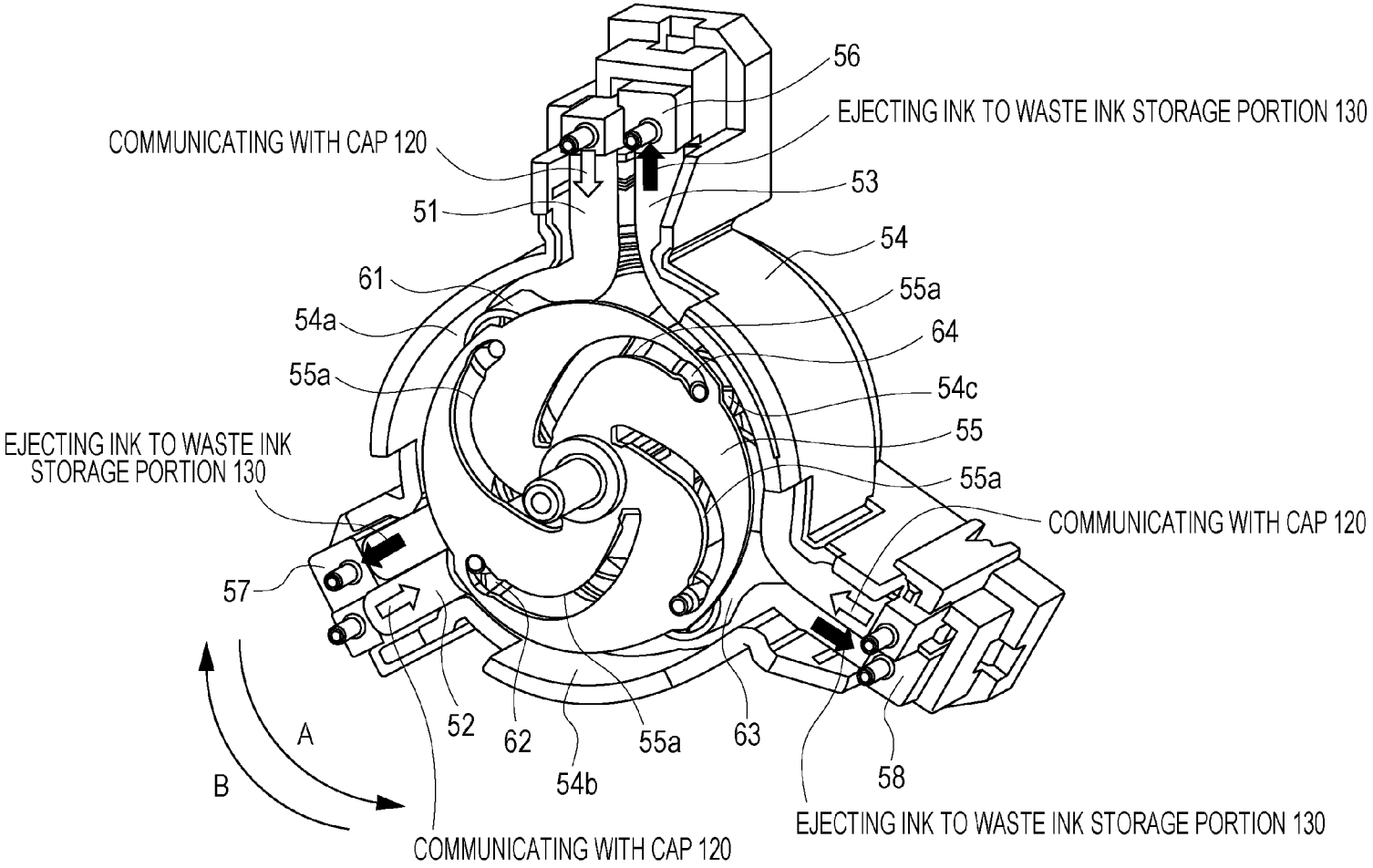
FIG. 9 is a perspective view of a tube pump according to a second embodiment of the present invention.
Figure 10:
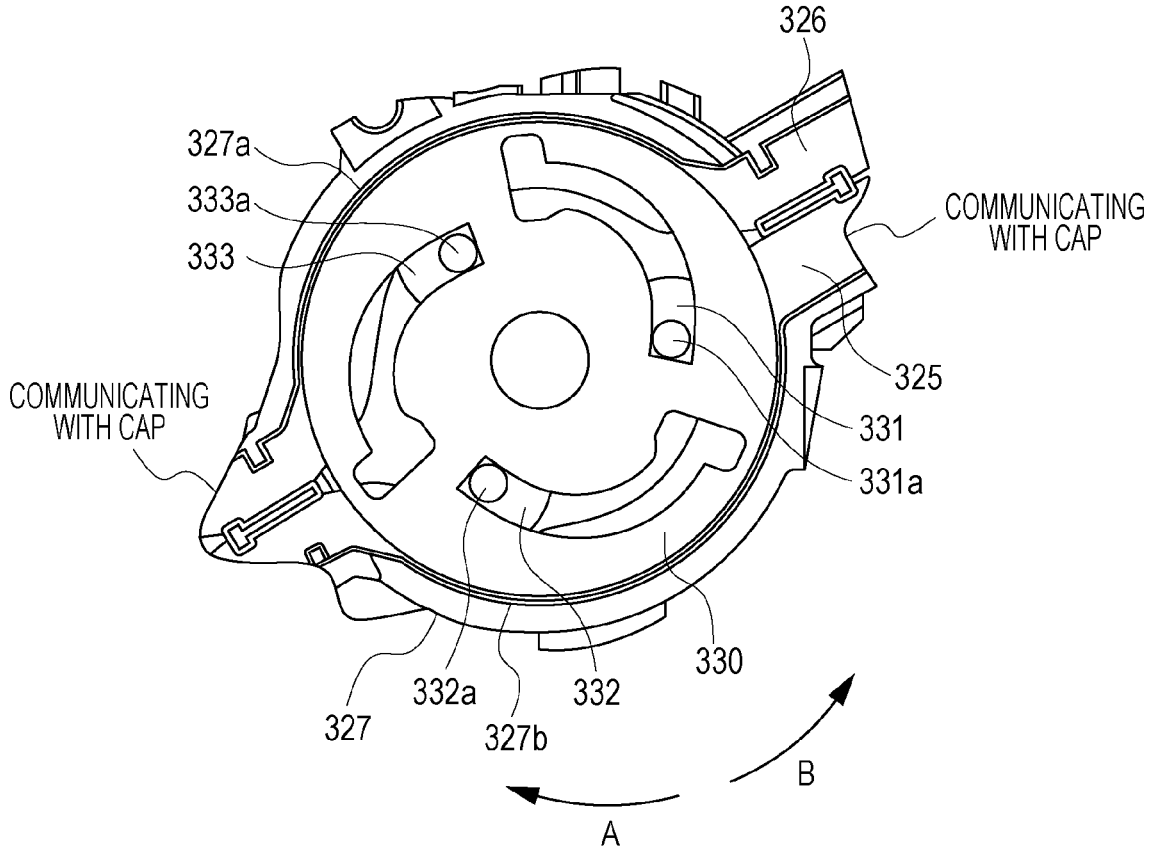
FIG. 10 is a plan view of a tube pump in related art.

FIG. 9 is a perspective view of a tube pump according to a second embodiment of the present invention. FIG. 9 illustrates the tube pump without the pump cover. The tube pump according to the first embodiment has a two-line configuration including two pump tubes. The tube pump according to the second embodiment has a three-line configuration including three pump tubes.

In FIG. 9, the tube pump includes a first pump tube 51, a second pump tube 52, and a third pump tube 53. Each of the three pump tubes has a first end communicating with the cap tube and a second end communicating with the waste ink tube.

The first end (cap-side end) of the first pump tube 51 and the second end (waste ink storage portion-side end) of the third pump tube 53 are fixed on a first tube joint 56, which is the first fixing member. The first end (cap-side end) of the second pump tube 52 and the second end (waste ink storage portion-side end) of the first pump tube 51 are fixed on a second tube joint 57, which is the second fixing member. The first end (cap-side end) of the third pump tube 53 and the second end (waste ink storage portion-side end) of the second pump tube 52 are fixed on a third tube joint 58, which is a third fixing member. The first tube joint 56, the second tube joint 57, and the third tube joint 58 are fixed on a pump base 54.

The pump base 54 includes a first guide surface 54*a* for guiding the first pump tube 51, a second guide surface 54*b* for guiding the second pump tube 52, and a third guide surface 54*c* for guiding the third pump tube 53. The first guide surface 54*a*, the second guide surface 54*b*, and the third guide surface 54*c* have arc shapes having the common center.

A pump roller wheel 55 is disposed on the pump base 54 such that it is rotatable by its shaft core coaxial with the center of the first guide surface 54*a*, the second guide surface 54*b*, and the third guide surface 54*c*. The pump roller wheel 55 has four grooves 55*a*. Pump rollers 61, 62, 63, and 64 capable of pressing the three pump tubes engage with the respective grooves 55*a* in the pump roller wheel 55. The pump base 54 engages with a pump cover (not illustrated). The pump cover includes a bearing portion for the pump roller wheel 55. That is, the pump roller wheel 55 is rotatably supported by the pump base 54 and the pump cover.

The first end (cap-side end) of the first pump tube 51 and the second end (waste ink storage portion-side end) of the third pump tube 53 are displaced from each other in the axial direction of the pump roller wheel 55 at the first tube joint 56. With this configuration, the first pump tube 51 and the third pump tube 53 can be arranged near each other with respect to a direction intersecting with the axial direction of the pump roller wheel 55, that is, with respect to the direction of the reference surface of the pump base 54. Accordingly, when the pump roller wheel 55 is rotated by a pump gear (not illustrated) in the direction in which the pressing by each of the pump rollers is released, the repelled pump roller detached from the first pump tube 51 immediately comes into contact with the third pump tube 53, and thus no noise occurs.

The configuration of the first end (cap-side end) of the second pump tube 52 and the second end (waste ink storage portion-side end) of the first pump tube 51 at the second tube joint 57 is substantially the same as the above-described configuration. The configuration of the first end (cap-side end) of the third pump tube 53 and the second end (waste ink storage portion-side end) of the second pump tube 52 at the third tube joint 58 is substantially the same as the above-described configuration.

According to the second embodiment, as described above, an ink jet printing apparatus including a low-noise compact pump tube capable of raising a suction pressure can be provided using a three-line tube pump. Such an ink jet printing apparatus can be provided using a tube pump having four or more lines.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-165122, filed Aug. 8, 2013, which is hereby incorporated by reference herein in its entirety.

What is claimed is:

1. An ink jet printing apparatus comprising:

a cap for capping an ejection port surface of a print head for ejecting ink;

first and second pump tubes communicating with the cap;

a guide member including a guide surface for guiding the first and second pump tubes and a reference surface intersecting with the guide surface;

a pump roller for pressing the first and second pump tubes;

a waste ink storage portion configured to store waste ink ejected from the first and second pump tubes; and a first fixing member including a first coupling portion coupled to a cap-side end of the first pump tube and a second coupling portion coupled to a waste ink storage portion-side end of the second pump tube, wherein a distance from the reference surface to the first coupling portion and a distance from the reference surface to the second coupling portion are different, and wherein the first pump tube coupled to the first coupling portion and the second tube pump tube coupled to the second coupling portion overlap each other with respect to a direction of the reference surface.

2. The ink jet printing apparatus according to claim 1, further comprising:

a second fixing member including a first coupling portion coupled to a cap-side end of the second pump tube and a second coupling portion coupled to a waste ink storage portion-side end of the first pump tube, wherein a distance from the reference surface to the first coupling portion of the second fixing member and a distance from the reference surface to the second coupling portion of the second fixing member are different.

3. The ink jet printing apparatus according to claim 2, wherein the first fixing member and the second fixing member are fixed on the guide member.

4. The ink jet printing apparatus according to claim 1, further comprising:

a pump roller holder holding the pump roller movably.

5. The ink jet printing apparatus according to claim 4, wherein the pump roller includes a shaft portion engaging with a groove formed in the pump roller holder.

6. The ink jet printing apparatus according to claim 1, further comprising:

a first cap tube that enables the cap and the first pump tube to communicate with each other; and a first waste ink tube that enables the first pump tube and the waste ink storage portion to communicate with each other.

7. The ink jet printing apparatus according to claim 6, further comprising:

a second cap tube that enables the cap and the second pump tube to communicate with each other; and a second waste ink tube that enables the second pump tube and the waste ink storage portion to communicate with each other.

8. The ink jet printing apparatus according to claim 1, further comprising:

a rotating member disposed on the guide member and configured to rotate the pump roller about a predetermined rotation axis, wherein the rotating member includes a surface intersecting with the rotation axis, and the surface includes the reference surface.

* * * * *